US006733939B2

(12) United States Patent
Nanya et al.

(10) Patent No.: US 6,733,939 B2
(45) **Date of Patent: *May 11, 2004**

(54) TONER, DEVELOPER AND CONTAINER FOR THE DEVELOPER, AND METHOD OF AND APPARATUS FOR FORMING AN IMAGE

(75) Inventors: Toshiki Nanya, Shizuoka (JP); Hiroyuki Fushimi, Shizuoka (JP); Osamu Uchinokura, Shizuoka (JP); Shinichiro Yagi, Shizuoka (JP); Kohki Katoh, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/964,622

(22) Filed: Sep. 28, 2001

(65) Prior Publication Data

US 2002/0064723 A1 May 30, 2002

(30) Foreign Application Priority Data

| | | |
|---|---|---|
| Sep. 28, 2000 | (JP) | 2000-296128 |
| Mar. 19, 2001 | (JP) | 2001-077761 |
| May 21, 2001 | (JP) | 2001-151460 |
| Aug. 24, 2001 | (JP) | 2001-254137 |

(51) Int. Cl.[7] ..... G03G 9/097

(52) U.S. Cl. ..... 430/108.22; 430/108.4; 430/108.5; 430/109.1; 430/109.4; 430/45; 430/124; 430/126; 222/DIG. 1

(58) Field of Search ..... 430/124, 126, 430/45, 108.22, 108.4–108.5, 109.4, 109.1

(56) References Cited

U.S. PATENT DOCUMENTS

| | | | | |
|---|---|---|---|---|
| 4,762,763 | A | | 8/1988 | Nomura et al. |
| 4,908,290 | A | | 3/1990 | Watanabe et al. |
| 4,933,250 | A | | 6/1990 | Nakayama et al. |
| 4,950,573 | A | | 8/1990 | Yamaguchi et al. |
| 4,956,258 | A | | 9/1990 | Watanabe et al. |
| 4,980,258 | A | | 12/1990 | Aoki et al. |
| 4,990,425 | A | | 2/1991 | Nanya et al. |
| 5,061,588 | A | | 10/1991 | Fushimi et al. |
| 5,079,123 | A | | 1/1992 | Nanya et al. |
| 5,085,965 | A | | 2/1992 | Nanya et al. |
| 5,102,766 | A | | 4/1992 | Nanya et al. |
| 5,168,028 | A | | 12/1992 | Nanya et al. |
| 5,225,303 | A | | 7/1993 | Tomita et al. |
| 5,288,577 | A | | 2/1994 | Yamaguchi et al. |
| 5,344,732 | A | | 9/1994 | Chiba et al. |
| 5,368,972 | A | | 11/1994 | Yamashita et al. |
| 5,403,690 | A | | 4/1995 | Kuramoto et al. |
| 5,429,901 | A | | 7/1995 | Muto et al. |
| 5,554,478 | A | | 9/1996 | Kuramoto et al. |
| 5,597,673 | A | | 1/1997 | Watanabe et al. |
| 5,721,083 | A | | 2/1998 | Masuda et al. |
| 5,728,501 | A | * | 3/1998 | Nakanishi et al. ..... 430/108.22 |
| 5,840,456 | A | | 11/1998 | Tomita et al. |
| 5,851,716 | A | | 12/1998 | Kuramoto et al. |
| 5,879,849 | A | | 3/1999 | Sawada et al. |
| 5,882,832 | A | | 3/1999 | Tosaka et al. |
| 6,004,715 | A | | 12/1999 | Suzuki et al. |
| 6,010,814 | A | | 1/2000 | KotsugaiI et al. |
| 6,074,794 | A | | 6/2000 | Fushimi et al. |
| 6,074,795 | A | | 6/2000 | Watanabe et al. |
| 6,103,441 | A | | 8/2000 | Tomita et al. |
| 6,180,298 | B1 | | 1/2001 | Kuroda et al. |
| 6,183,926 | B1 | | 2/2001 | Kuroda et al. |
| 6,212,351 | B1 | | 4/2001 | Kawagoe et al. |
| 6,228,550 | B1 | | 5/2001 | Matsuda et al. |
| 6,258,502 | B1 | | 7/2001 | Nakamura et al. |
| 6,269,228 | B1 | | 7/2001 | Kayahara et al. |
| 6,303,257 | B1 | | 10/2001 | Hasegawa et al. |
| 6,303,258 | B1 | | 10/2001 | Katoh et al. |
| 6,363,229 | B1 | | 3/2002 | Shiraishi et al. |
| 6,405,002 | B2 | | 6/2002 | Ogiyama et al. |
| 6,406,826 | B1 | | 6/2002 | Suzuki et al. |
| 6,445,900 | B2 | | 9/2002 | Fukao et al. |
| 6,449,453 | B1 | | 9/2002 | Motohashi |
| 6,505,024 | B2 | | 1/2003 | Kayahara et al. |
| 2003/0022080 | A1 | * | 1/2003 | Fushimi et al. ..... 430/108.4 |

FOREIGN PATENT DOCUMENTS

| | | | |
|---|---|---|---|
| DE | 196 11 731 | | 4/1997 |
| EP | 0 658 819 | | 6/1995 |
| EP | 0 831 378 | | 3/1998 |
| JP | 59-129862 | | 7/1984 |
| JP | 63-088564 | | 4/1988 |
| JP | 63-184762 | | 7/1988 |
| JP | 03-056974 | | 3/1991 |
| JP | 06-230609 | | 8/1994 |
| JP | 08-030017 | | 2/1996 |
| JP | 8-180493 | * | 2/1996 |
| JP | 09-171271 | | 6/1997 |
| JP | 09-211896 | | 8/1997 |
| JP | 11-218965 | * | 8/1999 |

OTHER PUBLICATIONS

Diamond, Arthur S. (editor) Handbook of Imaging Materials. New York: Marcel–Dekker, Inc. (199) pp. 162–165 & 212–215.*

U.S. patent application Ser. No. 10/615,770, Mochizuki et al., filed Jul. 10, 2003.

* cited by examiner

*Primary Examiner*—Christopher Rodee
(74) *Attorney, Agent, or Firm*—Oblon, Spiva, McClelland, Maier & Neustadt, P.C.

(57) ABSTRACT

The electrophotographic toner according to the present invention comprises a binder resin, a colorant, and a negative charge control agent. The binder resin is polyester and/or polyol. The negative charge control agent comprises components which are (1) sulfonic-acid containing monomers, (2) aromatic monomers having electron-withdrawing groups, and (3) acrylate monomers and/or methacrylate monomers. In particular, substituted phenyl maleimides and substituted phenyl itaconimides are prefereably used as the aromatic monomers. Moreover, n-butyl (meth)acrylates and 2-ethylhexyl (meth)acrylates are prefereably used as the acrylate monomers and/or methacrylate monomers.

26 Claims, 1 Drawing Sheet

TONER, DEVELOPER AND CONTAINER FOR THE DEVELOPER, AND METHOD OF AND APPARATUS FOR FORMING AN IMAGE

FIELD OF THE INVENTION

The present invention relates to an electrophotographic toner ("toner"), a developer and a container for the developer, a method of and an apparatus for forming image/s. More particularly, this invention relates to a toner used in a developer for developing images during electrophotography, electrostatic recording, electrostatic printing, and the like. Specific examples of such an apparatus for forming image are the copiers, laser printers or the plain-paper facsimiles, that involve a direct or indirect electrophotographic development system. Moreover, the apparatus for forming image may be a machine, like the full-color copiers, full-color laser printers or the full-color plain-paper facsimiles, that involve a direct or indirect electrophotographic multi-color image development system.

BACKGROUND OF THE INVENTION

A developer is used during electrophotography, electrostatic recording and electrostatic printing. In this process, first, the developer is deposited onto a substrate, such as a photosensitive body, on which an electrostatic image has been formed. Then, the developer is transferred from the photosensitive body onto a transfer medium such as a transfer paper. Then, the developer is fixed on a surface of a paper. Two types of developers are known. A two-component developer is the one that includes a carrier and a toner. A one-component developer is the one that does not have the carrier.

In case of the two-component developer, the carrier is used for charging and transporting the developer. After a mixture of the toner and carrier is agitated and mixed thoroughly in the development machine, the mixture is transported to the developer substrate and developed. In this system, charging and transport can be stably maintained even when the system is used for a relatively long period of time. For these reasons, the two-component developer can be efficiently used even in high-speed developing apparatuses.

However, in case of the two-component developer, the developer deteriorates as toner particles adhere on the surface of the carrier. Moreover, the concentration of the toner in the developer gradually decreases as only the toner is consumed. Moreover, since the ratio of the toner and the carrier in the developer has to be kept constant, there arises a problem, that size of the apparatus becomes large. The one-component developer is free from the problems listed in case of the two-component developer. Therefore, the size of the apparatus can be downsized. This advantage has made the one-component developer popular and widely used in present day developing systems.

The one-component developer can be further classified into two types. A magnetic one-component developer and a non-magnetic one-component developer. The magnetic one-component developer includes a magnetic material such as magnetite. This magnetic material is held on a substrate with a magnetic force. The substrate can be magnetized using a magnet. The magnetic toner on the substrate can be formed into a thin layer using a layer-thickness control member such as a blade or roller. This system has often been practically used recently for small-size printers.

As the name indicates, the non-magnetic one-component developer includes a non-magnetic toner. Therefore, the toner is supplied to a substrate by pressure welding a toner supply roller or the like onto the substrate. The toner is held firmly on the substrate with electrostatic force. The non-magnetic toner on the substrate can be formed into a thin layer in the same manner as the magnetic toner. The non-magnetic developer does not contain any colored substance. Therefore, the non-magnetic developer has an advantage over the magnetic developer in that the non-magnetic can be used for color image formation. Moreover, since the apparatus that uses the non-magnetic developer does not require any magnet the apparatus can be made light-weight and cheaper. These advantages have made the non-magnetic one-component developer popular and widely used in present day small-sized full-color printers.

However, the one-component developer still has many drawbacks. Since there is no stable charging and transport means as the carrier (as in case of the two-component developer), charging and transportation failures tend to occur frequently when the images are formed continuously for a considerably longer period of time or at higher speed.

As mentioned above, the one-component developer, after it is transported onto the developer substrate, is made into a thin layer by means of the layer-thickness control member and developed. At that time, contact between the toner and the developer, or contact between the toner and the layer-thickness control member is only for a very short period of time. Therefore, a time for which the toner is charged because of friction is very short. As a result, in contrast to the two-component development system using the carrier, more of the toner tends to have a low or opposite charge in the one-component development system. In the non-magnetic one-component system particularly, the toner (developer) is transported typically by means of at least one toner transport member. Apparently, it is known that the thickness of the toner layer on the toner transport member surface must be as thin as possible. Same is the case with the two-component developer having a carrier with a very small particle size. In particular, when a toner having a high electrical resistance is used as the one-component developer, the toner layer has to significantly thin since the toner has to be charged by the development apparatus. If the toner layer is thick, only a portion near the surface of the toner layer is charged and it becomes difficult to evenly charge the whole toner layer. Moreover, it is required that the toner is charged at speed that is fast, and an optimum level of charge is maintained.

The present day offices are flooded with office electric appliances such as personal computers, printers, copiers, scanners, and facsimile machines. Documents including text documents, graphs etc. are created using personal computers. Moreover, occasion where such documents are printed in color is increasing. Many of the images output by the printers are solid, line, or halftone images. Marketing needs for the image quality are changing accordingly and needs such as high reliability are increasing.

Conventionally, a charge control agent has been added to the toner to stabilize its charge. The charge control agent controls the frictional charge of the toner and maintains the charge level. Typical examples of negatively charging charge control agents are: monoazo dyes; metallic salts or metal complex salts of salicylic acid, naphthoic acid, and dicarboxylic acid; diazo compounds; and complex compounds of boron. Typical examples of positively charging charge control agents are, quaternary ammonium salt compounds, imidazole compounds, nigrosine dyes, and azine dyes. However, since these charge control agents are colored, there is a problem that the toner color phase is changed when they are used in color toners. Moreover, since these charge control agents have low dispersibility with a binder resin, the toner particles near the surface of the toner layer, i.e. the toner particles those contribute greatly to charging, tend to be detached easily, possibly causing problems such as variation in toner charging, staining of the development sleeve, "filming" on the photosensitive body, and the like.

This is why in the conventional charge control agents, images having a good quality are obtained at the initial stage, however, the image quality gradually changes, and the image starts to have background staining and unevenness. In particular, when the conventional charge control agents are used for a color copying machine, and the machine is used continuously while re-supplying the toner, there is a problem that the charge level of the toner gradually decreases and an image with a color tone significantly different from that of the image obtained at the initial stage is obtained. That is, conventionally, the machine is unable to withstand usage over a long period of time, and there is a problem that an image formation unit called a "process cartridge" has to be replaced at an early stage every few-thousand copies. The used process cartridges are bad for the ecology and the environment. Moreover, a lot of time and effort is spent on replacing, collecting the used process cartridges, and handling of the process cartridges. In addition, many of these charge control agents contain heavy metals such as chromium, and it has started to be a problem recently for safely reasons.

Resin charge control agents, having improved dispersibility with the binder resin, transparency of the toner fix image, and that are safe, have been disclosed in Japanese Laid Open Patent Application No. 63-88564, 63-184762, 3-56974, and 6-230609. Since these resin charge control agents have high dispersibility with the binder resin, they have good transparency and can be charged stably. However, in contrast to the toner using: monoazo dyes; or metallic salts or metal complex salts of salicylic acid, naphthoic acid, and dicarboxylic acid; there is a problem that the level to which the proposed resin charge control agents are charged ("charge level") or the speed at which they are charged ("charge speed") is lower. The chargeability can be improved by increasing the amount of the agent added to the toner but this will have a bad effect on the toner fixibility (i.e. fixibility at lower temperature, and offset resistivity). Moreover, the charge levels of these compounds have small environmental resistivity (i.e. resistance to humidity). Therefore there is a problem that background staining (fogging) tends to occur.

Furthermore, in Japanese Laid Open Patent Application No. 8-30017, 9-171271, 9-211896, and 11-218965, copolymers of monomers comprising, organic salts such as a sulfonate salts, and aromatic monomers having electron-withdrawing groups, have been proposed. Although these copolymers hold sufficient charge level, their dispersibility with the binder resin is not sufficient, because of their hygroscopicity and stickiness possibly arising from the monomers comprising organic salts such as sulfonate salts. Thus, when these copolymers are used, suppressing variation of toner charge over a long period of time, and effect of preventing staining of the development sleeve and "filming" on the photosensitive body, are not sufficiently achieved. Volatile matter content of the toner binder resin obtained by a publicly known polymerization method such as solution polymerization, bulk polymerization or the like, is normally between 0.5 and 2.0% by weight in the volatilization process. In the charge control agents according to the above patent application, moisture and polymerization solvents, possibly arising from the monomers comprising organic salts such as sulfonate salts, remain to a greater extent, and the volatile matter content is greater. Therefore, the charge control agents can not be stored satisfactorily, and there is a problem in handling that ingredients aggregate if left still after pre-mixing before kneading, making the powder transport impossible. Moreover, as dispersibility in the binder resin is not sufficient, suppressing variation of toner charge over a long period of time and effect of preventing staining of the development sleeve and "filming" on the photosensitive body are not sufficiently achieved. In addition, when these copolymers are used, sticking occurs in respective parts of the grinding machine and throughput of grinding per hour is low. Therefore considering the grinding process of the toner, the productivity is lower than that of the case where: monoazo dyes; or metallic salts or metal complex salts of salicylic acid, naphthoic acid, and dicarboxylic acid; are used as the charge control agent.

To increase the dispersibility in a styrene resin or polyester resin which is the binder resin, charge control agents comprising copolymers of: monomers comprising organic salts such as sulfonate salts; aromatic monomers having electron-withdrawing groups; and styrene monomers when the binder resin is a styrene resin, or polyester monomers when the binder resin is a polyester resin, have been proposed. However, effects of, maintaining the charge level over a long period of time, and preventing staining of the development sleeve and "filming" of the photosensitive body, are not sufficient. In particular, the effects on polyester or polyol resins that are preferably used in terms of color development and image intensity as the binder resin for full-color toners, are insufficient.

Furthermore, demand for printers has increased recently; advancing downsizing, increase in speed, and cost lowering of the device; and higher reliability and longer product life are demanded. Accordingly, it is required that the toner can maintain its demanded properties over a long period of time. However, the charge control effect cannot be maintained with these conventional resin charge control agents, and there are still problems that the development sleeve and the layer-thickness control member (such as a blade or roller) are stained, causing decrease in chargeability of the toner, and "filming" of the photosensitive body.

SUMMARY OF THE INVENTION

It is an object of the present invention to solve these problems without losing the advantages of the resin charge control agent which are good at its dispersibility in the binder resin, transparency of the toner fix image and its safety. In other words, it is the object of the invention to provide a toner, developer, method of and apparatus for forming image, in which the charge level and transport amount of the toner are stable, and high image quality with high image density and little background staining is achieved. More particularly, it is an object of the invention to provide the toner, developer, method of and apparatus for forming image, which allow, no variation in the toner chargeability after continuous printing, and acquirement of few ten-thousand or more copies with the image quality equivalent to that of the initially obtained image, in a one-component development system in which a thin layer of the toner is formed on a toner transport member (development sleeve), using a layer-thickness control member.

Further, it is another object of the invention to provide a toner, developer, method of and apparatus for forming image, in which staining of the development sleeve and layer-thickness control member (blade or roller) and "filming" of the photosensitive body are prevented throughout usage of processing few ten-thousand copies or more.

Further, it is another object of the invention to provide a toner, developer, method of and apparatus for forming image, in which there is little toner splash inside the development machine even when the machine is used for a long period of time.

Further, it is another object of the invention to provide a toner, developer, method of and apparatus for forming image, which allow usage of the development unit and the photosensitive body unit over a long period of time, decreasing effects on the ecological environment and displacement frequency of the units by the user.

Further, it is another object of the invention to provide a toner, developer, method of and apparatus for forming image, which achieve high color reproducibility by using an achromatic or hypochromic resin charge control agent.

Further, it is another object of the invention to provide a toner with high productivity that there is no sticking and overgrinding during grinding process and throughput of grinding per hour is great.

In order to achieve these objects and solve the problems in the conventional technology, the inventor/s investigated the component substances in the resin charge control agent. As a result, it was found, that a resin negative charge control agent having particular component substances were found to be effective in polyester or polyol resins that are preferable in terms of color development and image intensity as a binder resin for full-color toners. When this resin negative charge control agent is used, a toner having high level of charge and sharp charge distribution is obtained, and a toner, developer, method of and apparatus for forming image, which prevent staining of the development sleeve and layer-thickness control member and "filming" of the photosensitive body over a long period of time handling few ten-thousand copies or more, where high grindability and productivity are achieved, are provided.

The toner according to one aspect of the present invention comprises at least a binder resin, a colorant, and a negative charge control agent. The binder resin is polyester and/or polyol. Moreover, the negative charge control agent includes component units which are (1) sulfonic-acid containing monomers, (2) aromatic monomers having electron-withdrawing groups, and (3) acrylate monomers and or methacrylate monomers, is provided.

Different aspects of the invention will be described in detail below.

Examples of the sulfonic-acid containing monomers comprising the resin negative charge control agent, which may be used, are aliphatic-sulfonic-acid containing monomers, aromatic-sulfonic-acid containing monomers, and the like. Examples of the aliphatic-sulfonic-acid containing monomers for use are alkali metal salts, alkaline-earth metal salts, amine salts and quaternary ammonium salts of: vinylsulfonic acid, aryl vinylsulfonic acid, 2-acrylamide-2-methyl propane sulfonic acid, perfluoro octane sulfonic acid, methacryloyl oxyethyl sulfonic acid, or the like. Examples of the aromatic-sulfonic-acid containing monomers for use are alkali metal salts, alkaline-earth metal salts, amine salts and quaternary ammonium salts of: styrene sulfonic acid, sulfophenyl acrylamide, sulfophenyl itaconimide, or the like. Heavy metal (nickel, copper, zinc, mercury, chromium, and the like) salts are not preferable for safety reasons.

Examples of the aromatic monomers having electron-withdrawing groups, which can be used, are: substituted styrenes such as chlorostyrene, dichlorostyrene, bromostyrene, fluorostyrene, nitrostyrene, cyanstyrene, or the like; substituted phenyl (meth)acrylates such as chlorophenyl (meth)acrylate, bromophenyl (meth)acrylate, nitrophenyl (meth)acrylate, chlorophenyl oxyethyl (meth) acrylate, or the like; substituted phenyl (meth) acrylamides such as chlorophenyl (meth)acrylamide, bromophenyl (meth)acrylamide, nitrophenyl (meth)acrylamide, or the like; substituted phenyl maleimides such as chlorophenyl maleimide, dichlorophenyl maleimide, nitrophenyl maleimide, nitrochlorophenyl maleimide or the like; substituted phenyl itaconimides such as chlorophenyl itaconimide, dichlorophenyl itaconimide, nitrophenyl itaconimide, nirtochlorophenyl itaconimide, or the like; and substituted phenyl vinyl ethers such as chlorophenyl vinyl ether, nitrophenyl vinyl ether, or the like. In particular, phenyl maleimides and phenyl itaconimides substituted with chlorine atoms or nitro groups are preferable in terms of chargeability and "filming" resistance.

Examples of acrylate and/or metacrylate monomers, which may be used, are methyl (meth)acrylate, ethyl (meth) acrylate, propyl (meth)acrylate, n-butyl (meth)acrylate, isobutyl (meth)acrylate, stearyl (meth)acrylate, dodecyl (meth)acrylate, 2-ethylhexyl acrylate, or the like. Out of these, n-butyl (meth)acrylate and 2-ethylhexyl acrylate are particularly preferable.

Addition of sulfonic-acid containing monomers to the composition of the resin negative charge control agent will increase the negative charging effect of the agent. However, because the agent in this case is hygroscopic, the temperature-humidity stability will decrease, and this is why copolymers of sulfonic-acid containing monomers and aromatic monomers having electron-withdrawing groups are used, as it is generally known. When this charge control agent is used for a toner, while the toner can process a few thousand copies, if the toner is used for a long period of time processing a few ten-thousand copies or more, staining of the development sleeve and layer-thickness control member and "filming" of the photosensitive body occur, and toner charge stability and maintenance of high image quality will not be sufficient, resulting in low productivity. To compensate for this problem, polyester or polyol resins are used as the full-color toner binder resin for good color development and image strength, and copolymers comprising three kinds of monomers which are (1) sulfonic-acid containing monomers, (2) aromatic monomers having electron-withdrawing groups, and (3) acrylate monomers and/or methacrylate monomers, are used as the resin negative charge control agent. As a result, the electrographic toner which: has good chargeability and environmental resistivity over a long period of time; does not cause staining of the development sleeve and layer-thickness control member; is easily formed into a thin layer; can prevent "filming" of the photosensitive body; maintains high image quality; and has high productivity.

These effects supposedly arise from reasons explained below. By using sulfonic-acid containing monomers in combination with aromatic monomers having electron-withdrawing groups, the negative charging effect is increased. Using acrylate and/or methacrylate monomers in addition to the combination further increases the environmental resisitivity of the charge and increases resin hardness thus improving the grinding property. In addition, staining of the development sleeve and the layer-thickness control member does not occur, and effect of preventing "filming" of the photosensitive body is improved. Further, combining polyester or polyol resin as the full-color toner binder resin, which is preferable in terms of color development and image strength, optimum dispersibility of toner particles is achieved, and the toner having sharp charge distribution can be obtained. When this toner is used, charge stability and high image quality can be achieved over a long period of time.

Component ratio of the sulfonic-acid containing monomers to the resin charge control agent used for the toner of the invention, is preferably between 1 and 30% by weight, more preferably between 2 and 20% by weight. If the ratio of sulfonic-acid containing monomers to the resin negative charge control agent is less than 1% by weight, build-up of charging and level of charge are not sufficient and the image tends to be degraded. If the ratio of the sulfonic-acid containing monomer is increased to more than 30% by weight, environmental resistivity of the toner charge decreases, and thus the level of charge becomes low when temperature and humidity are high, and high when the temperature and humidity are low. Since the toner charge cannot be made stable, high image quality cannot be achieved sufficiently. Moreover, staining of the development sleeve and layer-thickness control member and "filming" of the photosensitive body tend to occur, and there arises a problem that the productivity of the toner during the kneading/grinding process decreases. The ratio of aromatic monomers having electron-withdrawing groups to the resin negative charge control agent is preferably between 1 and 80% by weight, more preferably between 20 and 70% by weight. If the ratio of aromatic monomers having electron-withdrawing groups is less than 1% by weight, the level of charge will not be sufficient tending to cause background staining and toner splash. On the other hand, if the ratio is more than 80% by weight, the dispersibility in the toner is low, charge distribution of the toner becomes broad, background staining and toner splash are easily caused, and high image quality cannot be maintained sufficiently. The ratio of the acrylate and/or methacrylate monomers to the resin negative charge control agent is preferably between 10 and 80% by weight, more preferably between 20 and 70% by weight. If the ratio is less than 10% by weight, environmental resistivity of the toner cannot be achieved sufficiently, grindability during the kneading/grinding process in the toner production will not be sufficient, and staining of the development sleeve and layer-thickness control member and "filming" of the photosensitive body cannot be prevented fully. On the other hand, if the ratio is more than 80% by weight, charge build-up and the level of charge will not be sufficient, and this tends to affect the image.

Aromatic vinyl monomers may be included further in the resin negative charge control agent used for the toner of the invention. Examples of the aromatic vinyl monomers for use are styrene, vinyltoluene, α-methylstyrene or the like. The ratio of the aromatic vinyl monomers to the resin negative charge control agent is preferably 30% by weight or less, more preferably between 3 and 20% by weight. If the ratio is more than 30% by weight, the resin becomes hard, its dispersiblity in the toner decreases, the charge distribution broadens, and background staining and toner splash in the machine tend to occur. Further, fixibility of the toner, and especially color development of the color toner during color mixture is degraded.

Dispersion particle size of these resin negative charge control agents, observed by a transmission electron microscope, is preferably between 0.05 and 1.50 μm lengthwise, and between 0.02 and 1.00 μm breadth-wise. If the length is more than 1.50 μm and the breadth is more than 1.00 μm, the toner charge distribution broadens and background staining and toner splash tend to occur. If the length is less than 0.05 μm and the breadth is less than 0.02 μm, charge build-up and level of charge will not be sufficient, and this tends to affect the image. Weight average diameter of the toner is preferably between 6.0 and 8.0 μm.

In order to form dispersion particles of the resin negative charge control agent, having diameter within the above range, for example, a single- or twin-screw extruder, or a batch kneading machine with a roll mill, is preferably used as a melting and kneading machine, when a mixture comprising developer components including the binder resin, negative charge control agent, pigment and by-product is placed in a kneading machine to be melted and kneaded. When a twin-screw extruder is used, the process should be carried out under correct conditions that do not cause breakage of molecular chains of the binder resin. Specifically, melting and kneading should be carried out at temperature taking into account the softening point of the binder resin. If the melting and kneading temperature is too lower than the softening point then breakage occurs severely, and if the temperature is too higher then dispersion does not proceed as desired. To obtain the desired dispersion particle size of the resin negative charge control agent used for the invention in the binder resin, each resin material should be formed into a particle size in powdery form, and screw rotation frequency of the twin-screw extruder and feed quantity of the mixture are correctly controlled under kneading temperature of between the softening point and the pour point.

Temperature at which the resin negative charge control agent used for the toner of the invention has an apparent viscosity of $10^4$ p ($10^4$ P=$10^4$ g/cm·s) is preferably between 85 and 110° C. If the temperature is less than 85° C., optimum dispersibility of the resin negative charge control agent in the toner is not provided. Further, not only the chargeability but also the storage stability is deteriorated and the agent tends to solidify (aggregate). In the kneading and grinding/classification processes of toner production, sticking of the resin negative charge control agent during the grinding process tends to happen and the productivity is decreased. If the temperature is more than 110° C., the dispersibility of the resin negative charge control agent in the toner decreases, the charge distribution broadens, and background staining and toner splash inside the machine tend to occur. Moreover, the toner fixiblity, especially the color development during color mixture of color toners, is degraded. The temperature at which the apparent viscosity becomes $10^4$ P is the temperature at which the apparent viscosity becomes $10^4$ P when the viscosity is measured with a flow tester where the load is 10 kg/cm$^2$, orifice is 1 mm×1 mm, and heating rate is 5° C./min. As the flow tester, a CFT-500 produced by Shimadzu Corporation can be used.

Volatile matter content of the resin negative charge control agent used for the toner of the invention is preferably 5% or less by weight. If the volatile matter content is more than 5% by weight, presence of residue such as moisture and polymerization solvents, possibly arising from the monomers comprising organic salts such as sulfonate groups decreases storage stability of the resin negative charge control agent itself. Further, when the materials before kneading are left still after pre-mixing, there is a problem in handling such an aggregate, making transport of the powder impossible. When the volatile matter content is more than 5% by weight, dispersion in the binder resin will not be sufficient, and suppression of variation in the toner charge over a long period of time, and prevention of "filming" of the development sleeve and photosensitive body cannot be achieved sufficiently. Further, during the grinding process of the toner, the toner sticks to respective sections of the grinding machine and productivity becomes lower in contrast the case in which: monoazo dyes; metallic salts and metal complex salts of salicylic acid, naphthoic acid, and dicarboxylic acid; are used as the charge control agent.

Volume resistivity of the resin negative charge control agent used for the toner of the invention is preferably between 9.5 and 11.5 log Ω·cm, more preferably between 10.0 and 11.0 log Ω·cm. These values are preferable because of variation in the volume resisitivity possibly arising from residues such as catalysts used in the synthesis, polymerization inhibitor, and solvents, remaining in, the aromatic monomers having electron-withdrawing groups, that are in the resin negative charge control agent; level of toner charge is affected, and the desired level of charge cannot be obtained. As a result, problems in the charge build-up of the toner comprising the resin negative charge control agent, and further charging up of the saturated charge, may occur. If the volume resistivity of the resin negative charge control agent is lower than 9.15 log Ω·cm, background staining and toner splash will occur, as the toner on the development roller cannot obtain sufficiently the desired level of charge at the initial stage. If the volume resistivity is higher than 11.51 log Ω·cm, the toner on the development roller can obtain the desired level of charge at the initial stage, however, the level is charged up over time. Thus in the one-component development system, the toner thin layer on the development roller becomes uneven, causing color streaks and unevenness on the image, and in the two-component development system, the image density decreases, and background staining and toner splash occur.

Weight average molecular weight of the resin charge control agent of the invention is preferably between 5000 and 100000. If the weight average molecular weight is less than 5000, sufficient dispersibility in the toner cannot be achieved, and the charge is decreased. Moreover, when kneading and grinding/classification of the toner are done, sticking during the grinding process easily occurs, lowering the productivity. If the weight is more than 100000, the dispersibility in the toner decreases, the charge distribution broadens, background staining and toner splash in the machine tend to occur, and fixibility and color development of the toner are degraded.

The resin charge control agent is typically adhered on the surface of particles to be the base ("base toner particle") or dispersed in the particles that are to be the base. Amount of the resin negative charge control agent, added in the toner of the present invention, to the base toner particle, is preferably between 0.1 and 20% by weight, more preferably between 0.5 and 10% by weight. If the amount is less than 0.1% by weight, build-up and level of charge is not sufficient affecting the image. If the amount is more than 20% by weight, the dispersibility decreases, charge distribution broadens, and background staining and toner splash in the machine are likely to occur. In addition to the resin negative charge control agent specified in the invention, at least one of the following substances: chrome complex of salicylic acid or chrome salts of salicylic acid, and chrome complex of alkyl salicylic acid and chrome salts of alkyl salicylic acid; can be used in combination.

The binder resin used for the toner of the invention is a polyester resin and/or polyol resin that is used as a full-color toner binder resin preferably in terms of color development and image strength. Since color images are obtained by overlapping several types of toner layers, the toner thickness becomes thick, causing cracks and defects in the image arising from lack of strength of the toner layers, and loss of gloss. To sustain enough gloss and excellent strength, polyester resins or polyol resins are therefore used.

The polyester resin can be obtained generally by esterification of polyhydric alcohol and polycarboxylic acid. Examples of alcohol monomers out of the monomers composing the polyester resin according to the present invention, which may be used, including polyfunctional monomers having hydroxyl values of three or more, are: diols such as ethylene glycol, diethylene glycol, triethylene glycol, 1,2-propylene glycol, 1,3-propylene glycol, 1,4-butadienol, neopentyl glycol, 1,4-butendiol, 1,5-pentandiol, 1,6-hexandiol, or the like; bisphenol A, hydrogenated bisphenol A, alkylene oxide added bisphenol A such as polyoxypropylene bisphenol A; other dihydric alcohols; sorbitol, 1,2,3,6-hexane tetrol, 1,4-sorbitan, penta erythritol, dipenta erythritol, tripenta erythritol, 1,2,4-butantriol, 1,2,5-pentantriol, glycerol, diglycerol, 2-methyl propantriol, 2-methyl-1,2,4-butantriol, trimethylol ethane, trymethylol propane, 1,3,5-trihydroxy benzene; and other polyhydric alcohols having hydroxyl values of three or more.

Out of the above-mentioned monomers composing the polyester resin, alkylene oxide added bisphenol A is preferable in particular, as the main component monomer. When alkylene oxide added bisphenol A is used as the component monomer, because of properties of the bisphenol A skeleton, a polyester having a relatively higher glass transition point is obtained, improving its copy blocking resistivity and heat preservability. Alkyl groups existing on both sides of the bisphenol A skeleton work as soft segments in the polymer, improving the color development during toner fixing and the image strength. In particular, alkylene oxide added bisphenol A having ethylene groups or propylene groups are preferably used.

Examples of acid monomers out of the monomers composing the polyester resin according to the present invention, which may be used, including polyfunctional monomers having acid radicals of three or more, are: maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, alkenyl succinic acids or alkyl succinic acids such as n-dodecenyl succinic acid and n-dodecyl succinic acid, anhydrides and alkyl esters of these acids, and other diacid carboxylic acids; 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-methylene-carboxy-propane, tetra-(methylene-carboxyl-)methane, 1,2,7,8-octanetetracarboxylic acid, empol trimer acid, anhydrides or alkyl esters or alkenyl esters or aryl esters of these acids; and other carboxylic acids having three acid radicals or more.

Specifically, examples of the acids composing the above-mentioned alkyl esters, alkenyl esters, oraryl esters for use are 1,2,4-benzentricarboxylic acid, trimethyl-1,2,4-benzenetricarboxylate, triethyl-1,2,4-benzenetricarboxylate, tri-n-butyl-1,2,4-benzenetri-carboxylate, isobutyl-1,2,4-benzenetricarboxylate, tri-n-octyl-1,2,4-benzenetricarboxylate, tri-2-ethylhexyl-1,2,4-benzenetricarboxylate, tribenzyl-1,2,4-benzenetricarboxylate, tris(4-isopropylbenzyl)-1,2,4-benzenetricarboxylate, and the like.

The chargeability of the polyester resin is proportionally related to its acid value. As the acid value increases, the negative chargeability of the resin is known to increase also, affecting its environmental resistivity at the same time. In other words, when the acid value is high, the level of charge becomes high at low temperature and humidity, and low at high temperature and humidity, causing background staining and wider variation in image density and color reproducibility that it is difficult to maintain the high image quality. Therefore the acid value of the polyester resin is preferably 20 mg KOH/g or less, more preferably 5 mg KOH/g or less.

Preferably, the polyol resin used in this invention is obtained by capping the ends of the epoxy resin and has a polyoxy alkylene portion in the principal chain, in terms of environmental resistivity of the charge, fixing stability, color reproducibility, gloss stability, and prevention of curling after fixing. For example, the polyol resin can be obtained by reacting epoxy resins having glycidyl groups on both ends and alkylene oxide added dihydric phenol having glycidyl groups on both ends, with dihalides, isocyanates, diamines, diols, polyhydricphenols, or, dicarboxylicacid. Reaction with dihydric phenol is the most preferablein terms of reaction stability. Polyhydric phenols or polyacidic carboxylic acids, in combination with dyhydric phenol, are also preferably used under conditions which gelation is not caused. The acid value of the polyol resin is preferably 20 mg KOH/g or less, more preferably 5 mg KOH/g.

Examples of the alkylene oxide addition product of dihydric phenols having glycidyl groups on both ends, composing the polyol resin of the invention are shown below. The examples are ethylene oxide, propylene oxide, butylenes oxide, and, reaction products of a mixture of these oxides and bisphenols such as bisphenol A or F. Products produced by glycidylation of the obtained addition products with epichlorohydrin, β-methyl epichlorohydrin, or the like, may also be used. In particular, glycidyl ethers, the alkylene oxide added bisphenol A, represented by a general formula (1) shown below is preferably used.

Volume average particle diameter of the toner particles is 4 to 9 μm, and ratio of volume average diameter Dv to number average diameter Dn, Dv/Dn, is preferably 1.5 or less, and this decreases the change in the image quality from that at the initial stage.

The toner of the present invention can be used as the one-component developer, or even as the two-component developer by mixing with a carrier. Even if this toner is used in any of the developers, level of toner charge and amount of toner transport are stable, maintaining the high image quality, even after usage over a long period of time, and can prevent staining inside the machine and "filming" of the photosensitive body. Further, the invention can be provided as a container encasing the developer or as an image formation apparatus.

When the toner of the invention is used in the two-component developer, carriers in which acrylic resin, fluorine resin, silicone resin, or the like is used as the coating agent are known for use, while silicone coated carrier is the most preferable in terms of developer life.

The method of forming image according to another aspect of the invention uses the one-component or the two-component developers of the invention as a developer. This method comprises the steps of: forming a latent image on a latent image substrate; developing the latent image using the developer on the developer substrate; transferring the developed toner image onto a transfer substrate; and heating the toner image on the transfer substrate thereby fixing the image onto the transfer substrate.

Furthermore, a thin layer of the developer is formed on the developer substrate, and the image is developed by contacting or non-contacting the thin layer with the latent image substrate, in the development step of the above image formation method.

Moreover, latent images having colors different from each other are formed on the latent image substrates respectively

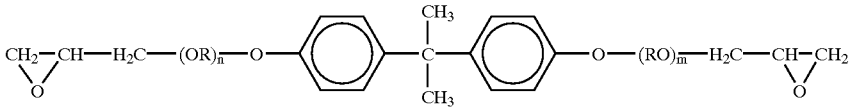

(1)

(wherein R is any one selected from the group consisting of —$CH_2$—$CH_2$—, $CH_2$—CH($CH_3$)—, and —$CH_2$—$CH_2$—$CH_2$—, while n and m represent number of repetitions, and both n and m are equal to or more than 1, and n+m=2 to 6.)

A method has been proposed in which a mixture of toner particles and inorganic powder such as various metallic oxides is used to improve fluidity and chargeability of the toner. The inorganic powder is called an external additive. A method in which the powder is processed with a particular silane coupling agent, titanate coupling agent, silicone oil, organic acids, or the like, and a method in which the powder is coated with a particular resin, have also been proposed, to increase the hydrophobicity, chargeability, and so on, of the inorganic powder surface if necessary. Examples of the inorganic powder known for use are silicon dioxide (silica), titanium dioxide (titania), aluminium oxide, zincoxide, magnesium oxide, cerium oxide, iron oxide, copper oxide, tin oxide, and the like. In particular, silica particles obtained by substituting the silanol groups with organic groups to increase the hydrophobicity after reacting silica or titanium oxide particles, with organic silicides such as dimethyl dicholorosilane, hexamethyl disilazane, silicone oil, or the like, are used.

by each color in the latent image formation step; using plurality of multi-color development apparatuses each provided with the developer substrate, and a development blade that regulates evenly layer-thickness of the developer supplied onto the developer substrate, each colored latent image is developed, onto the latent image substrate, with the correspondingly colored developer held on the developer substrate, in the development step; and the transfer substrate is abutted onto the latent image substrate surface using a transfer unit, and developed toner images differently colored from each other are electrostatically transferred onto the transfer substrate sequentially by each color, in the transfer step.

Furthermore, latent images having colors different from each other are formed on the latent image substrates respectively by each color in the latent image formation step; using plurality of multi-color development apparatuses each provided with a development roll, and a development blade that regulates evenly layer-thickness of the developer supplied onto the development roll, each colored latent image is developed, onto the latent image substrate, with the correspondingly colored developer held on the developer substrate, in the development step; and the transfer substrate is abutted onto the latent image substrate surface using a transfer unit, and the developed toner images differently colored from each other are electrostatically transferred onto the transfer substrate sequentially by each color, in the transfer step.

As the colorant, all generally known dyes and pigments can be used, for example, carbon black, nigrosin dye, iron black, naphthol yellow S, hansa yellow (10G, 5G, G), cadmium yellow, yellow iron oxide, ocher, chrome yellow, titan yellow, polyazo yellow, oil yellow, hansa yellow (GR, A, RN, R), pigment yellow L, benzidine yellow (G, GR), permanent yellow (NCG), vulcan fast yellow (5G, R), tartrazine lake, quinoline yellow lake, anthracene yellow BGL, isoindolinone yellow, red iron oxide, red lead, vermillion lead, cadmium red cadmium mercury red, antimony vermillion, permanent red 4R, para red, fire red, parachloro ortho nitro aniline red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmine 6B, pigment scarlet 3B, bordeau 5B, toluidine maroon, permanent bordeau F2K, helio bordeau BL, bordeau 10B, bon maroon light, bon maroon medium, eosin lake, rhodamine lake B, rhodamine lake Y, alizarin lake, thioindigo red B, thioindigo maroon, oil red, quinacridone red, pyrazolone red, polyazo red, chrome vermillion, benzidine orange, perinone orange, oil orange, cobalt blue, cerulean blue, alkali bluelake, peacock blue lake, victoria blue lake, non-metal phthalocyanine blues phthalocyanine blue, fast sky blue, indanthrene blue (RS, BC), indigo, ultramarine, iron blue, anthraquinone blue, fast violet B, methyl violet lake, cobalt purple, manganese purple, dioxane violet, anthraquinone violet, chromium green, zinc green, chromium oxide, pylidiane, emerald green, pigment green B, naphthol green B, green gold, acid green lake, malachite green lake, phthalocyanine green, anthraquinone green, titanium oxide, zinc white, lithopone and mixture of any combinations of the dyes and pigments above. Amount of the dyes and pigments to be used is generally between 0.1 and 50% by weight to 100% by weight of the binder resin.

To add mold releasability to the developer to be produced, waxes are preferably included in the developer. Melting point of the wax is preferably 40 to 120° C., more preferably 50 to 110° C. If the melting point is too high, fixibility at lower temperature may be inadequate. On the other hand, if the melting point is too low, the offset resistivity and durability may degrade. The melting point can be measured using differential scanning calorimetry (DSC). That is, a melting peak value found when a few mg of the wax sample is heated at a constant heating rate of, for example, 10° C./min, is the melting point.

Examples of the wax which can be used in this invention are: solid waxes such as paraffin wax, micro wax, rice wax, fatty acid amide waxes, fatty acid waxes, aliphatic monoketones, fatty acid metallic salt waxes, fatty acid ester waxes, partially saponified fatty acid ester waxes, silicone varnish, higher alcohols, carnauba wax, or the like. Further, polyolefins such as low molecular weight polyethylenes, polypropylenes, or the like may also be used. In particular, polyolefins obtained by ring and ball method having a softening point between 70 and 150° C. are preferable while the polyolefins having a softening point between 120 to 150° C. are more preferable. Amount of wax to be used is generally between 0.5 and 20% by weight to 100% by weight of the binder resin.

In order to improve cleansability, i.e. an ability to remove the developer remaining on the primary transfer medium after the transfer step, for example, metallic salts of fatty acids such as zinc stearate, calcium stearate, stearic acid, or the like; and polymer particles produced for example by soap-free emulsion polymerization of polymethyl methacrylate particles, polystyrene particles, or the like, can be used. The polymer particles having a relatively narrow particle distribution, and volume average particle diameter between 0.01 to 1 $\mu$m are preferably used.

Other objects and features of this invention will become apparent from the following description with reference to the accompanying drawings.

DESCRIPTION OF THE PREFERRED EMBODIMENTS

Figure 1:
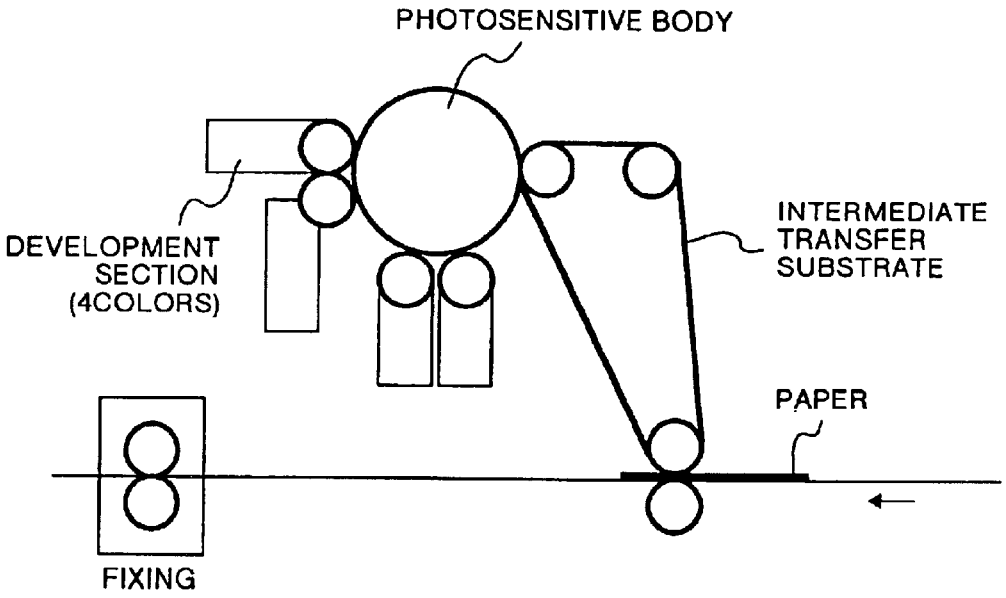
FIG. 1 shows a partial schematic structure of one example of the apparatus for forming image using the method of forming image according to the present invention.

The method of producing the toner according to the invention and the method of forming full-color image using the toner according to the present invention will be explained in detail while referring to accompanying drawings.

The method of producing the toner at least comprises: a mixing process in which developer components comprising at least a binder resin, a charge control agent and a colorant are mechanically mixed; a melting and kneading process; a grinding process; and a classification process. Furthermore, powder other than the product particles obtained in the grinding or classification process is returned and recycled to the mechanically mixing process and the melting and kneading process can be used when producing the toner.

The powder (by-product) other than the product particles referred to above means: fine or coarse particles other than the components composing the product having the desired particle size obtained in the grinding process after the melting and kneading process; and fine or coarse particles other than the components composing the product having the desired particle size obtained in the classification process performed after the grinding process. A mixture in which ratio of the by-product to the other raw materials is preferably between 1:99 and 50:50, is mixed in processes in which such by-products are mixed, or melted and kneaded.

The mixing process in which the developer components comprising a binder resin, charge control agent, colorant, and by-product, are mechanically mixed can be done using a normal mixing machine with rotating blades, and the way it is done is not particularly restricted.

When the mixing process is finished, the mixture is then placed in the kneading machine to be melted and kneaded. The melting and kneading machine, as explained already for making the dispersion particle size within the optimum range, can be a single- or twin-screw continuous kneading machine, or a batch kneading machine with a roll mill. For example, KTK two-screw extruder produced by Kobe Steel Ltd., TEM extruder produced by Toshiba Machine Co., Ltd., twin screw extruder produced by K. C. K. Co., Ltd., PCM twin screw extruder produced by Ikegai Corporation, cokneader produced by Coperion Buss A. G., or the like, are preferably used. It is important to perform the melting and kneading under conditions that do not cause breakage of molecular chains of the binder resin. Specifically, the melting and kneading should be done at a temperature taking into account the softening point of the binder resin. If the melting and kneading temperature is too lower than the softening point, the breakage occurs severely, and if too higher, dispersion does not proceed.

When the melting and kneading process is finished, the kneaded mixture is then ground. In the grinding process, coarse grinding is firstly done, followed by fine grinding. The grinding can be done preferably by colliding the mixture against a collision plate in a jet stream, or grinding in a narrow gap between a rotor and a stator that rotate mechanically.

When the grinding process is finished, the ground mixture undergoes classification using centrifugal force or the like in an airstream, and a toner having a predetermined particle size, for example, an average particle size between 5 and 20 μm, is produced. During the production, the above-mentioned inorganic particles such as hydrophobic silica particles, or the like, may be added and mixed into the toner obtained to improve the fluidity, shelf life, developing property, and transferability of the developer. Mixing of the external additive can be done with a general powder mixing machine, and temperature inside the machine is preferably kept under control by equipping a jacket or the like. To change history of the load applied to the external additive, the external additive is added midway or gradually. Of course, rotation frequency, rolling speed, mixing time, temperature, and so on, of the machine can be changed. A strong load at the beginning, followed by a comparatively weak load can be applied, or vice versa. Examples of the mixing machines for used are, a V-form mixing machine, a rocking mixer, a Redige mixer, a Nautor mixer, a Henshel mixer and the like.

When the toner of the invention is used for the two-component developer, the toner is mixed with a magnetic carrier. The ratio of the toner to the carrier in the developer is 1-10:100 by weight. As the magnetic carrier, iron powder, ferrite powder, magnetite powder, magnetic resin carrier, or the like, with a particle size between 20 and 200 μm, which have been generally known conventionally, may be used.

Examples of the carrier coating material that may be used are: amino resins such as urea-formaldehyde resin, melamine resin, benzoguanamine resin, urea resin, polyamide resin, epoxy resin, or the like; polyvinyl and polyvinylidene resins, such as acrylic resin, polymethyl methacrylate resin, polyacrylonitrile resin, polyvinyl acetate resin, polyvinyl alcohol resin, polyvinyl butyral resin, or the like; polystyrene resins such as polystyrene resin, styrene-acryl copolymer resin, or the like; halogenated olefin resins such as polyvinyl chloride, or the like; polyester resins such as polyethlene terephthalate resin, polybutylene terephthalate resin, or the like; polycarbonate resins; polyethylene resins; and poly vinyl fluoride resins, polyvinylidene fluoride resin, polytrifluoroethylene resin, polyhexafluoropropylene resin, copolymer of vinylidene fluoride and acrylic monomer, copolymer of vinylidene fluoride and vinyl fluoride, fluoro terpolymers such as terpolymer made of tetrafluoroethylene plus vinylidene fluoride plus non-fluoride monomer. In terms of developer life, silicon resin is preferable.

If necessary, powder that is electrically conductive, or the like, can be included in the above coating resins. As the conductive powder, metal powder, carbon black, titanium oxide, tin oxide, zinc oxide, or the like, can be used. Average particle size of the conductive powder is preferably 1 μm or less. If the size is larger than 1 μm, it becomes difficult to control the electrical resistance.

Now, a method of developing a full-color image will be explained. In the method of forming image according to the present invention, particularly in the non-magnetic one-component development system using the non-magnetic one-component full-color process, developing is carried out multiple times sequentially with the full-color toners that use the toner of the present invention. The toner is then superimposed on the transfer medium sequentially and in particular, a significant effect of the toner of the invention on reproducibility of the halftone evenness is achieved.

The method of forming full-color image using the non-magnetic one-component developer according to the present invention is a method of forming electrostatic latent images on the photosensitive bodies each having a color different to one another are developed, by developers corresponding to respective colors, sequentially, with a conductive brush charger plus an exposure apparatus and transferred onto the transfer medium, using plural multi-color development apparatuses comprising the development roller and the development blade that regulates the layer-thickness of the developer supplied onto the roller. In this case, it is preferable to use an inverted developing method in which the electrostatic latent image on the photosensitive body and the non-magnetic one-component developer have same polarity. Furthermore, the electrostatic latent image on the photosensitive body is preferably directly contacted with the development roller, and developed by rotating the roller at a higher speed than that of the photosensitive body.

FIG. 1 shows a partial schematic structure of one example of the apparatus for forming image using the method of forming image according to the present invention. The method of forming image used by the apparatus shown in FIG. 1 comprises following steps. That is, the latent image formation step in which an electrostatic latent image is formed on the organic photosensitive body drum or belt as the latent image substrate; the development step in which the electrostatic latent image is developed using the developer that is on the development roller, the developer substrate; the transfer step in which the developed toner image is primarily transferred onto the intermediate transfer substrate, and secondarily transferred onto the transfer paper; and the fixing step in which the toner image on the transfer paper is heated and fixed using the heat roller or belt. The developer used to form the images may be the one-component or two-component developer containing the toner of the present invention. Moreover, in the development process, a thin layer of the developer is formed on the developer substrate, and the image is developed by contacting or non-contacting the thin layer with the latent image substrate to form the image.

Figure 2:
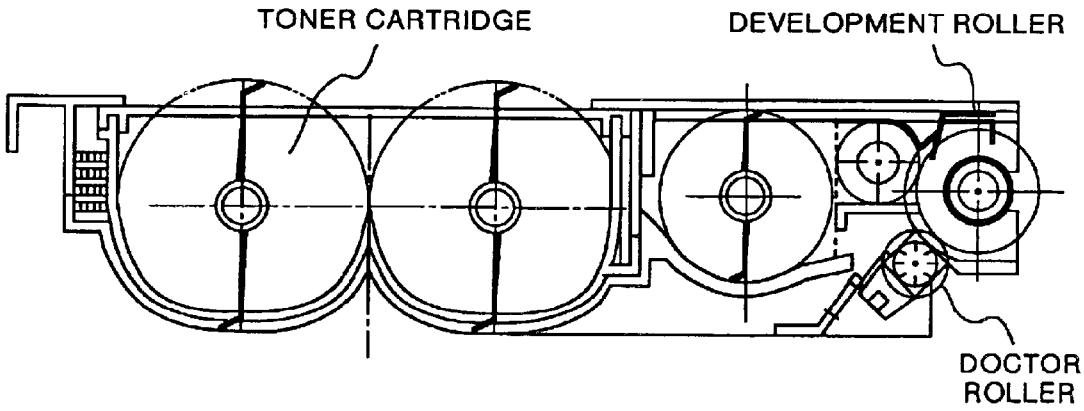
FIG. 2 shows the partial schematic structure of another example of a multi-color development apparatus using the method of forming image according to the present invention.

The method of forming image according to the invention can also be used by the apparatus for forming image shown in FIG. 2. Using plurality of the development apparatuses as shown in FIG. 2 equipped with the development roller and the doctor roller that evenly regulates the layer-thickness of the developer supplied onto the roller, the electrostatic latent images formed on the latent image substrates each having a color different to one another are developed by developers corresponding to respective colors onto the latent image substrates, and the toner images are electrostatically transferred onto the transfer substrate sequentially by abutting the transfer unit onto the latent image retaining surface via the transfer substrate. In this method, the image is formed using the one-component or two-component developer using the toner of the present invention.

The present invention will be explained in detail by referring to examples and comparative examples, however, the invention should not be restricted to these examples. In the examples, all parts and percentages mentioned are on a weight basis unless it is particularly specified. Firstly, synthesis examples 1 to 7 for synthesizing the resin negative control agent used for the toner of the invention, and synthesis example 8 for synthesizing the charge control agent which is not composed of acrylate and/or methacrylate monomers, will be explained. Secondly, synthesis examples for synthesizing the polyester resins A–D, and polyol resins A–B, which are the binder resins used for the toner of the invention, will be described. Thirdly, as example 1, toner production example 1 (toner T1) for producing toners of four colors using these synthesized materials will be described and method and results of the evaluation of, the image formation using the toner, and the image obtained, will be shown. Fourthly, in examples 2 to 12 and comparative examples 1 to 3, the obtained toners, No. T2 to T15, are used respectively in order to form images, and results of the evaluation will be explained.

The negative charge control agent can be synthesized as mentioned concretely in the following synthesis examples 1 to 8.

Synthesis Example 1:

Firstly, using ditertiary butyl peroxide as an initiator, 350 parts of 3,4-dichlorophenyl maleimide and 100 parts of 2-acrylamide-2-methyl propane sulfonic acid were co-polymerized for 8 hours in dimethylformaldehyde (DMF) under its boiling point. Secondly, 500 parts of n-butyl acrylate, and 50 parts of styrene were added and graft-polymerized for 4 hours using the same initiator. Thirdly, the DMF was removed using a reduced-pressure drying machine. Finally, a charge control resin A of which, its volatile matter content was 1.0%, its volume resistivity was 10.5 log Ω·cm, its weight average molecular weight was 10000, and temperature at which its apparent viscosity becomes $10^4$ P was 96° C., was obtained.

Synthesis Example 2:

Firstly, using ditertiary butyl peroxide as an initiator, 600 parts of m-nitrophenyl maleimide and 100 parts of perfluoro octane sulfonic acid were co-polymerized for 8 hours in dimethylformaldehyde (DMF) under its boiling point. Secondly, 250 parts of 2-ethylhexyl acrylate, and 30 parts of styrene were added and graft-polymerized for 4 hours using the initiator. Thirdly, the DMF was removed using a reduced-pressure drying machine. Finally, a charge control resin B of which, its volatile matter content was 3.8%, its volume resistivity was 9.5 log Ω·cm, its weight average molecular weight was 5500, and temperature at which its apparent viscosity becomes $10^4$ P was 85° C., was obtained.

Synthesis Example 3:

Firstly, using ditertiary butyl peroxide as an initiator, 500 parts of 3,4-dichlorophenyl maleimide and 150 parts of 2-acrylamide-2-methyl propane sulfonic acid were co-polymerized for 8 hours in dimethylformaldehyde(DMF) under its boiling point. Secondly, 350 parts of n-butyl acrylate, and 250 parts of α-methylstyrene were added and graft-polymerized for 4 hours using the initiator. Thirdly, the DMF was removed using a reduced-pressure drying machine. Finally, a charge control resin C of which, its volatile matter content was 0.5%, its volume resistivity was 11.5 log Ω·cm, its weight average molecular weight was 95000, and temperature at which its apparent viscosity becomes P was 110° C., was obtained.

Synthesis Example 4:

Firstly, using ditertiary butyl peroxide as an initiator, 400 parts of 3,4-dichlorophenyl maleimide and 200 parts of perfluoro octane sulfonic acid were co-polymerized for 8 hours in dimethylformaldehyde(DMF) under its boiling point. Secondly, 300 parts of n-butyl acrylate were added and graft-polymerized for 4 hours using the initiator. Thirdly, the DMF was removed using a reduced-pressure drying machine. Finally, a charge control resin D of which, its volatile matter content was 1.7%, its volume resistivity was 10.3 log Ω·cm, its weight average molecular weight was 50000, and temperature at which its apparent viscosity becomes $10^4$ P was 105° C., was obtained.

Synthesis Example 5:

Firstly, using ditertiary butyl peroxide as an initiator, 400 parts of 3,4-dicholorophenyl maleimide and 100 parts of 2-acrylamide-2-methyl propane sulfonic acid were co-polymerized for 8 hours in dimethylformaldehyde (DMF) under its boiling point. Secondly, 500 parts of n-butyl acrylate, and 100 parts of styrene were added and graft-polymerized for 4 hours using the initiator. Thirdly, the DMF was removed using a reduced-pressure drying machine. Finally, a charge control resin E of which, its volatile matter content was 4.8%, its volume resistivity was 9.6 log Ω·cm, its weight average molecular weight was 30000, and temperature at which its apparent viscosity becomes $10^4$ P was 101° C., was obtained.

Synthesis Example 6:

Firstly, using ditertiary butyl peroxide as an initiator, 400 parts of 3,4-dicholorophenyl maleimide and 200 parts of 2-acrylamide-2-methyl propane sulfonic acid were co-polymerized for 8 hours in dimethylformaldehyde (DMF) under its boiling point. Secondly, 200 parts of n-butyl acrylate, and 400 parts of styrene were added and dissolved. Thirdly, the DMF was removed using a reduced-pressure drying machine. Finally, a charge control resin F of which, its volatile matter content was 0.6%, its volume resistivity was 11.7 log Ω·cm, its weight average molecular weight was 115000, and temperature at which its apparent viscosity becomes $10^4$ P was 110° C., was obtained.

Synthesis Example 7:

Firstly, using ditertiary butyl peroxide as an initiator, 450 parts of 3,4-dicholorophenyl maleimide and 150 parts of perfluoro octanesulfonic acid were co-polymerized for 3 hours indimethylformaldehyde (DMF) under its boiling point. Secondly, 500 parts of methyl acrylate were added and graft-polymerized for 4 hours using the initiator. Thirdly, the DMF was removed using a reduced-pressure drying machine. Finally, a charge control resin G of which, its volatile matter content was 5.2%, its volume resistivity was 9.2 log Ω·cm, its weight average molecular weight was 2800, and temperature at which its apparent viscosity becomes $10^4$ P was 80° C., was obtained.

Synthesis Example 8:

Firstly, using ditertiary butyl peroxide as an initiator, 60 parts of sodium styrene sulfonate and 440 parts of nitrophenyl maleimide and 500 parts of perfluoro alkyl ethyl methacrylate were co-polymerized for 3 hours in dimethylformaldehyde (DMF) under its boiling point. Secondly, the DMF was removed using a reduced-pressure drying machine. Finally, a charge control resin H of which, its volatile matter content was 1.2%, its volume resistivity was 10.2 log Ω·cm, and its softening point was 137° C., was obtained.

The polyester resin can be synthesized as concretely mentioned in the following synthesis examples 1 to 4.

Synthesis Example 1:

In a four-neck separable flask equipped with a stirrer, a thermometer, a nitrogen inlet, a falling condenser, and a cooling pipe, a mixuture of, 740 g of polyoxy propylene (2,2)-2,2-bis(4-hydroxyphenyl)propane, 300 g of polyoxy ethylene (2,2)-2,2-bis(4-hydroxylphenyl) propane, 466 g of dimethyl terephthalate, 80 g of iso-dodecenyl succinic anhydride, and 114 g of tri-n-butyl-1,2,4-benzenetricarboxylate, was added with an esterification catalyst. In nitrogen atmosphere, the mixture was firstly heated under normal pressure to 210° C., and later stirred to undergo a reaction at 210° C. under reduced pressure. A polyester resin (referred to as polyester resin A below) having an acid value of 22.3 mg KOH/g, a hydroxyl value of 28.0 mg KOH/g, a softening point of 106° C., and Tg of 62° C., was obtained.

Synthesis Example 2:

In the flask, a mixture of, 725 g of polyoxy propylene (2,2)-2,2-bis(4-hydroxyphenyl) propane, 165 g of polyoxy ethylene (2,2)-2,2-bis(4-hydroxylphenyl) propane, 500 g of terephthalic acid, 130 g of iso-dodecenyl succinic anhydride, and 170 g of tri-isopropyl-1,2,4-benzenetricarboxylate, was added with an esterification catalyst. The mixture was reacted using the same apparatus and in the same manner as those in the synthesis example 1. A polyester resin (referred to as polyester resin B below) having an acid value of 0.5 mg KOH/g, a hydroxyl value of 25.0 mg KOH/g, a softening point of 109° C., and Tg of 63° C., was obtained.

Synthesis Example 3:

In the flask, a mixture of, 650 g of polyoxy propylene (2,2)-2,2-bis(4-hydroxyphenyl) propane, 650 g of polyoxy ethylene (2,2)-2,2-bis(4-hydroxylphenyl) propane, 515 g of isophtalic acid, 70 g of iso-octenyl succinic acid, and 80 g of 1,2,4-benzenetricarboxylic acid, was added with an esterification catalyst. The mixture was reacted using the same apparatus and in the same manner as those in the synthesis example 1. A polyester resin (referred to as polyester resin C below) having an acid value of 19.5 mg KOH/g, a hydroxyl value of 35.0 mg KOH/g, a softening point of 110° C., and Tg of 60° C., was obtained.

Synthesis Example 4:

In a flask, a mixture of, 714 g of polyoxy propylene (2,2)-2,2-bis(4-hydroxyphenyl) propane, 663 g of polyoxy ethylene (2,2)-2,2-bis(4-hydroxylphenyl) propane, 648 g of isophthalic acid, 150 g of iso-octenyl succinic acid, and 100 g of 1,2,4-benzenetricarboxylic acid, was added with an esterification catalyst. The mixture was reacted using the same apparatus and in the same manner as those in the synthesis example 1. A polyester resin (referred to as polyester resin D below) having an acid value of 21.0 mg KOH/g, a hydroxyl value of 24.0 mg KOH/g, a softening point of 128° C., and Tg of 65° C., was obtained.

The polyol resin can be synthesized as concretely mentioned in the following synthesis examples 1 and 2.

Synthesis Example 1:

In a separable flask equipped with a stirrer, a thermometer, a nitrogen inlet, and a cooling tube, a mixuture of, 378.4 g of low molecular weight bisphenol A epoxy resin (number average molecular weight: approx. 360), 86.0 g of high molecular weight bisphenol A epoxy resin (number average molecular weight: approx. 2700), 191.0 g of glycidylation products of propylene-oxide-added bisphenol A (where n+m: approx. 2.1 in the general formula (1)), 274.5 g of bisphenol F, 70.1 g of p-cumylphenol, and 200 g of xylene, was added. In nitrogen atmosphere, the mixture was heated to 70–100° C. After that, 0.1839 g of lithium chloride was added, the mixture was further heated to 160° C., and xylene was removed under reduced pressure. The mixture was then polymerized for 7–9 hours at reaction temperature of 180° C. Finally, a polyol resin (referred to as polyol resin A below) having an acid value of 0.0 mg KOH/g, a hydroxyl value of 70.0 mg KOH/g, a softening point of 110° C., and Tg of 62° C., was obtained.

Synthesis Example 2:

In the apparatus of synthesis example 1, a mixture of, 205.3 g of low molecular weight bisphenol A epoxy resin (number average molecular weight: approx. 360), 54.0 g of high molecular weight bisphenol A epoxy resin (number average molecular weight: approx. 3000), 432.0 g of glycidylation products of propylene-oxide-added bisphenol A (where n+m: approx. 2.2 in the general formula (1)), 282.7 g of bisphenol F, 26.0 g of p-cumylphenol, and 200 g of xylene, was added. In nitrogen atmosphere, the mixture was heated to 70–100° C. After that, 0.183 g of lithium chloride was added, the mixture was further heated to 160° C., and xylene was removed under reduced pressure. The mixture was then polymerized for 6–8 hours at reaction temperature of 180° C. Finally, a polyol resin (referred to as polyol resin B below) having an acid value of 0.0 mg KOH/g, a hydroxyl value of 58.0 mg KOH/g, a softening point of 105° C., and Tg of 58° C., was obtained.

Now an example will be described below in which a toner T1 was produced, an image was formed using the toner, and evaluation of the image was done.

Toner Production Example 1:

(1) Production of Black Particles

Firstly, a mixture comprising 1200 parts of water, 200 parts of phthalocyanine green hydrate cake (solid content: 30%), and 540 parts of carbon black (Printex 35, produced by Degussa Corporation; DBP oil absorption=42 ml/100 mg; pH=9.5) was stirred thoroughly in a flasher. Secondly, 1200 parts of polyester resin A was added to the mixture, and the mixture was kneaded for 30 minutes at 150° C. Thirdly, 1000 parts of xylene was added to the mixture, and the mixture was kneaded further for one hour. Finally, after the water and xylene were removed, the mixture was rolled and cooled, and ground with a pulpelyzer to obtain a masterbatch pigment.

After that, firstly, a mixture of, 100 parts or polyester resin A, 5 parts of the above masterbatch, and 5 parts of charge control resin A, was mixed in a Henshel mixer. Secondly, the mixture was melted and kneaded with a double roll mill, and the kneaded mixture was rolled and cooled. Thirdly, air classification (DS classifier produced by Nippon Pneumatic Mfg. Co., Ltd.) using, a grinding machine (I-2 mill produced by Nippon Pneumatic Mfg. Co., Ltd.) of collision plate system with a jet mill, and swirl flow. Finally, black colored particles having a number average diameter of 5.2 $\mu$m, volume average diameter of 6.5 $\mu$m (Dv/Dn=1.3) were obtained. The grinding throughput during the process per hour was 2.3 kg/h.

(2) Production of Yellow Particles

Firstly, a mixture comprising 600 parts of water and 1200 parts of Pigment Yellow 17 hydrate cake (solid content: 50%) was stirred thoroughly in a flasher. Secondly, 1200 parts of polyester resin A was added to the mixture, and the mixture was kneaded for 30 minutes at 150° C. Thirdly, 1000 parts of xylene was added to the mixture, and kneaded further for one hour. Finally, after the water and xylene were removed, the mixture was rolled and cooled, ground with a pulpelyzer, and passed through a triple roll, to obtain a masterbatch pigment.

After that, firstly, a mixture of, 100 parts of polyester resin A, 5 parts of the above masterbatch, and 5 parts of charge control resin A, was mixed in a Henshel mixer. Secondly, the mixture was melted and kneaded with a double roll mill, and the kneaded mixture was rolled and cooled. Thirdly, the mixture was ground and classified in the same manner as that in the production example of black colored particles. Finally, yellow colored particles having a number average diameter of 5.4 μm, volume average diameter of 6.6 μm (Dv/Dn=1.2) were obtained. The grinding throughput during the process per hour was 2.3 kg/h.

(3) Production of Magenta Particles

Firstly, a mixture comprising 600 parts of water and 1200 parts of Pigment Red 57 hydrate cake (solid content: 50%) was stirred thoroughly in a flasher. Secondly, 1200 parts of polyester resin A was added to the mixture, and the mixture was kneaded for 30 minutes at 150° C. Thirdly, 1000 parts of xylene was added to the mixture, and kneaded further for one hour. Finally, after the water and xylene were removed, the mixture was rolled and cooled, ground with a pulpelyzer, and passed through a triple roll twice, to obtain a masterbatch pigment.

After that, firstly, a mixture of, 100 parts of polyester resin A, 5 parts of the above masterbatch, and 5 parts of charge control resin A, was mixed in a Henshel mixer. Secondly, the mixture was melted and kneaded with a double roll mill, and the kneaded mixture was rolled and cooled. Thirdly, the mixture was ground and classified in the same manner as that in the production example of black colored particles. Finally, magenta colored particles having a number average diameter of 5.2 μm, volume average diameter of 6.8 μm (Dv/Dn=1.3) were obtained. The grinding throughput during the process per hour was 2.3 kg/h.

(4) Production of Cyan Particles

Firstly, a mixture comprising 600 parts of water and 1200 parts of Pigment Blue 15:3 hydrate cake (solid content: 50%) was stirred thoroughly in a flasher. Secondly, 1200 parts of polyester resin A was added to the mixture, and the mixture was kneaded for 30 minutes at 150° C. Thirdly, 1000 parts of xylene was added to the mixture, and kneaded further for one hour. Finally, after the water and xylene were removed, the mixture was rolled and cooled, ground with a pulpelyzer, and passed through a triple roll twice, to obtain a masterbatch pigment.

After that, firstly, a mixture of, 100 parts of polyester resin A, 3 parts of the above masterbatch, and 5 parts of charge control resin A, was mixed in a Henshel mixer. Secondly, the mixture was melted and kneaded with a double roll mill, and the kneaded mixture was rolled and cooled. Thirdly, the mixture was ground and classified in the same manner as that in the production example of black colored particles. Finally, cyan colored particles, having a number average diameter of 5.9 μm, and volume average diameter of 6.9 μm (Dv/Dn=1.2), were obtained. The grinding throughput during the process per hour was 2.3 kg/h.

(5) Mixing With the External Additive

To 100 parts of each of the four colors of particles, 1.0 part of hydrophobici silica (HDK H2000 produced by Wacker-ChemieGmbH), 1.0 part of hydrophobic silica (aerosil RX-50 produced by Nippon Aerosil Co., Ltd.), and 0.5 part of hydrophobic titanium oxide (MT-150AI produced by TAYCA Corporation) were added as the external additives. The mixture was mixed in a Henshel mixer, and coarse particles and aggregates were removed by passing the mixture through a mesh having a mesh size of 100 μm to obtain a toner T1 having four colors.

To evaluate the image formed with a two-component developer using the toner produced as above, a ferrite carrier, that is coated with a silicone resin of an average thickness of 0.3 μm and has an average particle size of 50 μm, is used. Using a TURBULA mixer in which a container is rolled over to stir the mixture, a mixture comprising 5 parts of one of the colored toners and 100 parts of the carrier was evenly mixed and charged to obtain each colored developer.

The toners obtained were evaluated using the following evaluating machines A to D. The evaluating machine A was a full-color laser printer IPSiO 5000 (produced by Ricoh Co., Ltd.) in which the four colors of non-magnetic one-component developers are: developed by development sections for four colors, on a photosensitive belt, sequentially by each color; transferred onto an intermediate transfer substrate sequentially; and then transferred onto paper or the like in four colors simultaneously. The evaluation machine B was a tandem-style full-color LED printer GL8300 (produced by Fujitsu Ltd), comprising non-magnetic one-component development sections for four colors and photosensitive bodies for four colors, in which transfer is done sequentially onto a transfer paper or the like. The evaluation machine C was a full-color laser copying machine, imagio Color 2800 (produced by Ricoh Co., Ltd.), in which: development by each color is done onto one photosensitive drum by development sections for four colors comprising the two-component developers; transfer onto an intermediate transfer body is done sequentially; and the four colors of toners are transferred simultaneously onto a transfer paper or the like. The evaluation machine D is a full-color laser printer IPSiO color 8000 (produced by Ricoh Co., Ltd). The development sections of the machines A and B are provided with a non-magnetic one-component development unit comprising a development roller made of an elastic body and a stainless blade for layer-thickness regulation. Further, all the four evaluation machines use the reversal development system in which the polarity of the electrostatic latent image on the photosensitive body is the same as that of the non-magnetic one-component developer. Combinations of example or comparative example, and the evaluation machine used, are shown in later-described tables 2-1 to 2-3.

The images were evaluated as follows. That is, after an image chart with an image area of 5% was run through to obtain 100000 copies. The results of the evaluation are shown in table 2 together with the results of examples 2 to 12 and comparative examples 1 to 3.

1. Image Density

A solid image was output and the image density was measured with X-Rite (produced by X-Rite, Inc.). This was done at five points for each color to find an average image density.

2. Background Staining

A blank image was developed, the developer on the photosensitive body after the development process was transferred onto a tape, and the difference between the image densities on the tape and a blank tape was measured using 938 spectrodensitometer (produced by X-Rite, Inc.).

3. Filming

States of any occurrence of toner filming on the development roller or the photosensitive body were observed. Symbols, ○, Δ, and × were used to indicate the states, "no filming", "streaky filming", and "allover filming", respectively.

4. Streaks

States of any occurrence of color streaks on the toner thin layer over the development roller and the image were observed. Symbols, ○, Δ, and × were used to indicate the states, "scarcely any color streaks", "several streaks", and "allover streaks", respectively.

5. Physical Properties

5–1. Particle Size:

Toner particle size was measured using a particle size analyzer, "Coulter Counter TAII" produced by Beckman Coulter, Inc., with an aperture size of 100 μm. Volume average particle size and number average particle size, were measured with the particle size analyzer.

5–2. Level of Charge:

For the two-component developer; 6 g of the developer was weighed, placed in a sealable metallic cylinder, and blowed to measure the charge. The toner concentration was adjusted to be between 4.5 and 5.5% by weight.

For the one-component developer; the toner was transported onto the development roller (sleeve), and the charge was measured by suction tribo method under respective conditions. The conditions for high and low temperature/humidity were 32° C./80% RH and 10° C./30% RH respectively.

5–3. Dispersion Particle Size of the Resin Negative Charge Control Agent:

The toner was made into ultra-thin sections, dyed with ruthenium oxide, and the state of dispersion was observed using a photographic image enlarged by magnification of 5000–20000 times with transmission electron microscope H-800 produced by Hitachi, Ltd.

6. Transparency

A sample was prepared with an OHP sheet at a fixing speed of 90 mm/s at 160° C. The transparency was measured with a haze meter (produced by Suga Test Instruments Co. Ltd.). Symbols ○, Δ and × were used to indicate the haze percentages of, 15% or less, less than 30%, and 30% or more, respectively.

7. Volatile Matter Content of the Resin Negative Charge Control Agent

Accurately 1.5–2.0 g of a sample ground to pass through a 20 mesh were weighed, and left still for 45 minutes in an air circulation dryer (produced by Tabai Espec Corp.) at 150° C. After that the sample was taken out of the dryer and the dry residue was accurately weighed to calculate the volatile matter content using the equation below.

$$\text{Volatile matter content (\%)}=(1-\text{dry residue weight/sample weight})\times 100.$$

8. Volume Resistivity of the Resin Negative Charge Control Agent 3 g of resin powder sized with a sieve or the like for example, was compressed at approximately 500 kgf/cm$^2$, to be molded into a pellet having approximately an area of 12.5 cm$^2$, and a thickness between 1.8 and 2.2 mm. The pellet was measured with a commercial dielectric-loss-analyzer (produced by Ando Electric Co., Ltd., TR-1° C. type) with a frequency of 1 kHz being applied, to determine the volume resistivity.

9. Productivity

As already described, air classification (DS classifier produced by Nippon Pneumatic Mfg. Co., Ltd.) using a grinding machine (I-2 mill produced by Nippon Pneumatic Mfg. Co., Ltd.) of collision plate system with a jet mill, and swirl flow, was done, adjusting in a such a manner that colored particles having a volume average diameter of 6.5 μm (Dv/Dn=1.5 or less) were obtained, and the grinding throughput (kg/h) per hour was measured for the process. If the grinding throughput was 2.0 (kg/h) or more, and there was no aggregation, and adhesion onto the pipe arrangement, of the materials, a symbol ○ was used to indicate the evaluation. If there was, aggregation, and adhesion onto the pipe arrangement, of the materials, a symbol × was used to indicate the evaluation.

Toner Production Examples 2–12:

As shown in the later-described table 1, the toner particle size, charge control resin, amount of charge control resin added, and binder resin were selected, and 4 colors of toners were respectively produced in the same manner as that of example 1. The toners obtained are referred to as toners T2 to T12. An image was formed using each toner, and the same evaluation as that of example 1 was done. The results are shown in the later-described tables 2-1 to 2-3.

COMPARATIVE EXAMPLE 1

In comparative example 1, the toner (toner T13) was produced in the same manner as that of example 1, except that zinc salt of salycilic acid derivative was used as the resin negative charge control, added by an amount shown in table 1. The zinc salt of salycilic acid derivative used was Bontron E-84 produced by Orient Chemical Industries Ltd. An image was formed using the toner obtained, and evaluation was done in the same manner as that of example 1. The results are shown in tables 2-1 to 2-3 below.

COMPARATIVE EXAMPLE 2

In comparative example 2, the toner (toner T14) was produced in the same manner as that of example 1, except that styrene-acryl resin was used as the binder resin. The styrene-acryl resin used was a copolymer made of styrene and n-BMA, having Mn of 5000, Mw of 12000, and Tg of 61° C. An image was formed using the toner and evaluated in the same manner as that in example 1. The results are shown in tables 2-1 to 2-3 below.

COMPARATIVE EXAMPLE 3

In comparative example 3, the toner (toner T15) was produced in the same manner as that of example 1, except that a charge control agent not comprising acrylate monomers and/or methacrylate monomers was used to be added by an amount shown in table 2. An image was formed using the toner and evaluated in the same manner as that in example 1. The results are shown in tables 2-1 to 2-3 below.

TABLE 1

| Toner No. | Volume average diameter Dv | Number average diameter Dn | Dv/Dn | Charge control agent (CCA) | Amount of CCA added (parts by weight) | Binder resin | Trans-parency | Grind-ability |
|---|---|---|---|---|---|---|---|---|
| T1 | 6.5~6.9 | 5.2~5.9 | 1.2~1.3 | CCA resin A | 3.00 | PolyesterA | ○ | ○ |
| T2 | 6.3~6.8 | 4.9~5.6 | 1.2~1.4 | CCA resin B | 3.50 | PolyolA | ○ | ○ |
| T3 | 6.5~6.9 | 4.3~5.1 | 1.3~1.5 | CCA resin A | 5.00 | PolyesterB | ○ | ○ |
| T4 | 6.5~6.9 | 5.3~6.0 | 1.1~1.2 | CCA resin C | 3.00 | PolyesterB | ○ | ○ |
| T5 | 6.3~6.8 | 4.9~5.6 | 1.2~1.4 | CCA resin A | 2.50 | PolyesterA | ○ | ○ |
| T6 | 6.5~6.9 | 4.3~5.1 | 1.3~1.5 | CCA resin A | 2.00 | PolyolB | ○ | ○ |
| T7 | 6.5~6.9 | 5.3~6.0 | 1.1~1.2 | CCA resin D | 2.00 | PolyesterB/ PolyolA | ○ | ○ |
| T8 | 6.3~6.8 | 4.9~5.6 | 1.2~1.4 | CCA resin E | 2.00 | PolyesterC | ○ | ○ |

TABLE 1-continued

| Toner No. | Volume average diameter Dv | Number average diameter Dn | Dv/Dn | Charge control agent (CCA) | Amount of CCA added (parts by weight) | Binder resin | Trans-parency | Grind-ability |
|---|---|---|---|---|---|---|---|---|
| T9 | 6.5~6.9 | 5.5~6.1 | 1.1~1.3 | CCA resin F | 1.50 | PolyesterA | Δ | X |
| T10 | 6.5~6.9 | 4.3~5.1 | 1.3~1.5 | CCA resin G | 2.50 | PolyesterB | Δ | X |
| T11 | 6.5~6.9 | 5.7~5.9 | 1.1~1.2 | CCA resin A | 4.00 | PolyesterD | Δ | Δ |
| T12 | 6.5~6.9 | 4.3~5.1 | 1.3~1.5 | CCA resin A | 22.00 | PolyolA | Δ | ○ |
| T13 | 6.5~6.9 | 5.2~5.9 | 1.2~1.3 | Zinc salt of salycilic acid derivative | 3.00 | PolyesterA | ○ | ○ |
| T14 | 6.3~6.8 | 4.9~5.6 | 1.2~1.4 | CCA resin A | 3.50 | Styrene-acryl resin | Δ | ○ |
| T15 | 6.5~6.9 | 5.2~5.9 | 1.2~1.3 | CCA resin H | 3.00 | PolyesterD | Δ | Δ |

TABLE 2

(Table 2-1)
Results at initial stage of continuous processing

| | Toner No. | Evaluation machine | Charge (mC/kg) High temp/humi-dity | Charge (mC/kg) Low temp/humi-dity | Image density | Background staining | Streaks | Filming |
|---|---|---|---|---|---|---|---|---|
| Examples | | | | | | | | |
| 1 | T1 | A | −23~−28 | −26~−32 | 1.6~1.7 | 0.00 | ○ | ○ |
| 2 | T2 | A | −20~−24 | −25~−29 | 1.6~1.8 | 0.01 | ○ | ○ |
| 3 | T3 | A | −28~−32 | −31~−35 | 1.5~1.7 | 0.00 | ○ | ○ |
| 4 | T4 | B | −27~−32 | −32~−38 | 1.5~1.7 | 0.01 | ○ | ○ |
| 5 | T5 | D | −22~−27 | −26~−31 | 1.6~1.7 | 0.00 | ○ | ○ |
| 6 | T6 | C | −28~−33 | −32~−37 | 1.7~1.8 | 0.00 | | ○ |
| 7 | T7 | D | −21~−24 | −23~−29 | 1.6~1.8 | 0.00 | ○ | ○ |
| 8 | T8 | A | −21~−25 | −25~−28 | 1.6~1.8 | 0.01 | ○ | ○ |
| 9 | T9 | A | −25~−30 | −30~−34 | 1.3~1.7 | 0.05 | Δ | ○ |
| 10 | T10 | C | −14~−19 | −21~−26 | 1.2~1.6 | 0.07 | | Δ |
| 11 | T11 | A | −25~−30 | −38~−44 | 1.3~1.7 | 0.04 | ○ | ○ |
| 12 | T12 | A | −36~−45 | −51~−60 | 0.8~1.1 | 0.01 | Δ | ○ |
| Results | | | | | | | | |
| 1 | T13 | A | −12~−18 | −22~−28 | 1.2~1.6 | 0.42 | ○ | ○ |
| 2 | T14 | A | −10~−15 | −18~−23 | 1.1~1.5 | 0.35 | Δ | ○ |
| 3 | T15 | A | −14~−18 | −20~−25 | 1.2~1.7 | 0.26 | Δ | ○ |

TABLE 3

(Table 2-2)
Results after processing 100,000 copies

| | Toner No. | Evaluation machine | Charge (mC/kg) High temp/humi-dity | Charge (mC/kg) Low temp/humi-dity | Image density | Background staining | Streaks | Filming |
|---|---|---|---|---|---|---|---|---|
| Examples | | | | | | | | |
| 1 | T1 | A | −22~−27 | −25~−30 | 1.6~1.7 | 0.00 | ○ | ○ |
| 2 | T2 | A | −21~−26 | −27~−32 | 1.6~1.7 | 0.02 | ○ | ○ |
| 3 | T3 | A | −25~−30 | −28~−33 | 1.6~1.7 | 0.00 | ○ | ○ |
| 4 | T4 | B | −24~−29 | −28~−33 | 1.6~1.7 | 0.01 | ○ | ○ |
| 5 | T5 | D | −21~−26 | −24~−29 | 1.6~1.7 | 0.00 | ○ | ○ |
| 6 | T6 | C | −29~−34 | −31~−36 | 1.7~1.8 | 0.00 | | ○ |
| 7 | T7 | D | −20~−25 | −22~−37 | 1.6~1.8 | 0.00 | ○ | ○ |
| 8 | T8 | A | −20~−24 | −22~−26 | 1.7~1.8 | 0.01 | ○ | ○ |
| 9 | T9 | A | −20~−24 | −22~−26 | 1.3~1.7 | 0.15 | X | ○ |
| 10 | T10 | C | −13~−18 | −18~−24 | 1.0~1.5 | 0.13 | | Δ |
| 11 | T11 | A | −23~−27 | −33~−38 | 1.0~1.5 | 0.03 | ○ | ○ |
| 12 | T12 | A | −39~−45 | −48~−56 | 0.8~1.1 | 0.23 | Δ | Δ |

TABLE 3-continued (Table 2-2)
Results after processing 100,000 copies

| | Toner No. | Evaluation machine | Charge (mC/kg) High temp/humidity | Charge (mC/kg) Low temp/humidity | Image density | Background staining | Streaks | Filming |
|---|---|---|---|---|---|---|---|---|
| Comparative examples | | | | | | | | |
| 1 | T13 | A | −8~−14 | −17~−23 | 0.9~1.4 | 0.68 | ○ | ○ |
| 2 | T14 | A | −7~−11 | −13~−18 | 0.8~1.3 | 0.55 | X | Δ |
| 3 | T15 | A | −10~−15 | −18~−21 | 1.0~1.5 | 0.37 | | X |

TABLE 4

(Table 2-3)
Results after processing 100,000 copies

| | Toner No. | Evaluation machine | Charge (mC/kg) High temp/humidity | Charge (mC/kg) Low temp/humidity | Image intensity | Background staining | Streaks | Filming | Overall Evaluation |
|---|---|---|---|---|---|---|---|---|---|
| Examples | | | | | | | | | |
| 1 | T1 | A | −20~−24 | −24~−29 | 1.7~1.8 | 0.01 | ○ | ○ | ○ |
| 2 | T2 | A | −20~−25 | −25~−29 | 1.7~1.8 | 0.02 | ○ | ○ | ○ |
| 3 | T3 | A | −23~−77 | −26~−31 | 1.6~1.7 | 0.01 | ○ | ○ | ○ |
| 4 | T4 | B | −27~−31 | −33~−36 | 1.6~1.7 | 0.02 | ○ | ○ | ○ |
| 5 | T5 | D | −20~−24 | −24~−28 | 1.7~1.8 | 0.01 | ○ | ○ | ○ |
| 6 | T6 | C | −26~−30 | −31~−35 | 1.6~1.8 | 0.01 | | ○ | ○ |
| 7 | T7 | D | −18~−23 | −21~−26 | 1.7~1.8 | 0.02 | ○ | ○ | ○ |
| 8 | T8 | A | −17~−22 | −22~−25 | 1.6~1.8 | 0.02 | ○ | ○ | ○ |
| 9 | T9 | A | — | — | — | — | — | — | Δ |
| 10 | T10 | C | — | — | — | — | | — | Δ |
| 11 | T11 | A | −19~−23 | −28~−34 | 1.3~1.7 | 0.05 | ○ | ○ | Δ |
| 12 | T12 | A | — | — | — | — | — | — | Δ |
| Comparative examples | | | | | | | | | |
| 1 | T13 | A | — | — | — | — | — | — | X |
| 2 | T14 | A | — | — | — | — | — | — | X |
| 3 | T15 | A | — | — | — | — | | — | X |

Thus, the present invention provides a toner that can be used in any of the two-component and one-component color development systems. This toner is such, that even after continuous printing for a longer period of time, in contrast to the conventional art, "filming" on the photosensitive body, developer-layer-thickness control member and development sleeve is prevented, charging and transport of the toner is stabilized, and image density plus high quality output image equivalent to those of the image obtained at the initial stage can be maintained. Since decrease in level of charge during continuous usage is small, there are no problems such as variation of the image density, low reproducibility, bad development, backgrouond staining, and toner splash in the machine, and an image with good color development and color reproducibility can be obtained. Because of this long-term durability, product lives of the development unit, photosensitive unit and the like can be increased and amounts of recycling items and wastes produced after usage are less than those in the conventional art, decreasing the trouble of replacing these image formation units by the user. Further, in the production processes of kneading, grinding and classifying the toner, the toner can be obtained with high productivity.

The present document incorporates by reference the entire contents of Japanese priority documents, 2000-296128 filed in Japan on Sep. 28, 2000, 2001–077761 filed in Japan on Mar. 19, 2001, 2001–151460 filed in Japan on May 21, 2001, and 2001-254137 filed in Japan on Aug. 24, 2001.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An electrophotographic toner comprising at least a binder resin, a colorant, and a resin negative charge control agent, wherein said binder resin is a polyester, a polyol, or a polyester and a polyol and said resin negative charge control agent comprises polymerized units of (1) sulfonic acid-containing monomers, (2) aromatic monomers having electron-withdrawing groups, and (3) at least one selected from the group consisting of methyl(meth)acrylate, ethyl (meth)acrylate, propyl(meth)acrylate, n-butyl(meth) acrylate, isobutyl(meth)acrylate, stearyl(meth)acrylate, dodecyl(meth)acrylate, 2-ethylhexylacrylate and combinations thereof.

2. The electrophotographic toner according to claim 1, wherein the weight % of said sulfonic acid-containing monomers based on the weight of the resin negative charge control agent is between 1 to 30% by weight; the weight % of the aromatic monomers having electron-withdrawing groups based on the weight of said resin negative charge control agent is between 1 to 80% by weight; and the weight % of the acrylate and/or methacrylate monomers (3) based on the weight of said resin negative charge control agent is between 10 to 80% by weight.

3. The electrophotographic toner according to claim 1, wherein said aromatic monomers having electron-withdrawing groups are at least one selected from the group consisting of phenyl maleimides and phenyl itaconimides substituted with chlorine atoms or nitro groups.

4. The electrophotographic toner according to claim 1, wherein said resin negative charge control agent further comprises polymerized units of one or more aromatic vinyl monomers.

5. The electrophotographic toner according to claim 4, wherein the weight percentage of said aromatic vinyl monomers contained in the resin negative charge control agent is 30% based on the total weight of the resin negative charge control agent.

6. The electrophotographic toner according to claim 1, wherein said resin negative charge control agent has a dispersion particle size of between 0.05 and 1.50 $\mu$m lengthwise, and between 0.02 and 1.00 $\mu$m breadth-wise.

7. The electrophotographic toner according to claim 1, wherein said resin negative charge control agent has an apparent viscosity of 104 P (where 104 P=104 g/cm·s) between 85 and 110° C.

8. The electrophotographic toner according to claim 1, wherein said resin negative charge control agent has a volatile matter content of 5% or less by weight based on the total weight of said resin negative charge control agent.

9. The electrophotographic toner according to claim 1, wherein said resin negative charge control agent has a volume resistivity of between 9.5 and 11.5 log Ω·cm.

10. The electrophotographic toner according to claim 1, wherein said resin negative charge control agent has a weight average molecular weight of between 5000 and 100000.

11. The electrophotographic toner according to claim 1, wherein the weight % of said resin negative charge control agent based on the weight of the base toner particles is between 0.1 and 20% by weight.

12. The electrophotographic toner according to claim 1, wherein said binder resin has an acid value of 20 mg KOH/g or less.

13. The toner of claim 1, comprising a polyester binder resin.

14. The toner of claim 1, comprising a polyol binder resin.

15. The toner of claim 1, comprising a monomer (3) selected from the group consisting of 2-ethylhexylacrylate, n-butyl(meth)acrylate and mixtures thereof.

16. A one-component developer which comprises an electrophotographic toner, said electrophotographic toner comprising at least a binder resin, a colorant, and a resin negative charge control agent, wherein said binder resin is a polyester, a polyol, or a polyester and a polyol, and said negative charge control agent comprises polymerized units of (1) sulfonic acid-containing monomers, (2) aromatic monomers having electron-withdrawing groups, and (3) at least one selected from the group consisting of methyl(meth)acrylate, ethyl(meth) acrylate, propyl(meth)acrylate, n-butyl(meth)acrylate, isobutyl(meth)acrylate, stearyl(meth)acrylate, dodecyl (meth)acrylate, 2-ethylhexylacrylate and combinations thereof.

17. A two-component developer which comprises a carrier and an electrophotographic toner, said electrophotographic toner comprising at least a binder resin, a colorant, and a resin negative charge control agent, wherein said binder resin is a polyester, a polyol, or a polyester and a polyol, and said negative charge control agent comprises polymerized units of (1) sulfonic acid-containing monomers, (2) aromatic monomers having electron-withdrawing groups, and (3) at least one selected from the group consisting of methyl(meth) acrylate, ethyl(meth)acrylate, propyl(meth)acrylate, n-butyl(meth)acrylate, isobutyl(meth)acrylate, stearyl (meth)acrylate, dodecyl(meth)acrylate, 2-ethylhexylacrylate and combinations thereof.

18. The two-component developer according to claim 17, wherein said carrier is coated with a resin.

19. A container encasing a one-component developer, said developer comprising an electrophotographic toner, said electrophotographic toner comprising at least a binder resin, a colorant, and a resin negative charge control agent, wherein said binder resin is a polyester, a polyol, or a polyester and a polyol, and said negative charge control agent comprises polymerized units of (1) sulfonic acid-containing monomers, (2) aromatic monomers having electron-withdrawing groups, and (3) at least one selected from the group consisting of methyl(meth)acrylate, ethyl(meth) acrylate, propyl(meth)acrylate, n-butyl(meth)acrylate, isobutyl(meth)acrylate, stearyl(meth)acrylate, dodecyl (meth)acrylate, 2-ethylhexylacrylate and combinations thereof.

20. A container encasing a two-component developer said developer comprising a carrier and an electrophotographic toner, said electrophotographic toner comprising at least a binder resin, a colorant, and a resin negative charge control agent, wherein said binder resin is a polyester, a polyol, or a polyester and a polyol, and said negative charge control agent comprises polymerized units of (1) sulfonic acid-containing monomers, (2) aromatic monomers having electron-withdrawing groups, and (3) at least one selected from the group consisting of methyl(meth)acrylate, ethyl(meth) acrylate, propyl(meth)acrylate, n-butyl(meth)acrylate, isobutyl(meth)acrylate, stearyl(meth)acrylate, dodecyl (meth)acrylate, 2-ethylhexylacrylate and combinations thereof.

21. A method of forming image using a one-component developer which contains an electrophotographic toner, said electrophotographic toner comprising at least a binder resin, a colorant, and a resin negative charge control agent, wherein said binder resin is a polyester, a polyol, or a polyester and a polyol, and said resin negative charge control agent comprises polymerized units of (1) sulfonic-acid containing monomers, (2) aromatic monomers having electron-withdrawing groups, and (3) at least one selected from the group consisting of methyl(meth)acrylate, ethyl (meth)acrylate, propyl(meth)acrylate, n-butyl(meth)

acrylate, isobutyl(meth)acrylate, stearyl(meth)acrylate, dodecyl(meth)acrylate, 2-ethylhexylacrylate and combinations thereof, the method comprising:

forming a latent image on a latent image substrate;

developing the latent image, fanned on the latent image substrate, using the one-component developer on a developer substrate;

transferring the developed toner image onto a transfer substrate; and heating the toner image on the transfer substrate thereby fixing the image onto the transfer substrate.

22. The method of forming image according to claim 21, further comprising forming a thin layer of the one-component developer on the developer substrate before developing the latent image, wherein when developing the latent image the thin layer of the one-component developer is contacted or non-contacted with the latent image substrate, in said developing.

23. The method of forming image according to claim 21, wherein latent images having colors different from each other are formed on the latent image substrates respectively by each color when forming the latent image on the latent image substrate;

using plurality of multi-color development apparatuses each provided with said developer substrate, and a development blade that regulates evenly layer-thickness of the one-component developer supplied onto said developer substrate, each colored latent image is developed onto said latent image substrate with the correspondingly colored developer held on said developer substrate, when developing the latent image; and said transfer substrate is abutted onto said latent image substrate surface using a transfer unit, and developed toner images differently colored from each other are electrostatically transferred onto said transfer substrate sequentially by each color, when transferring the developed toner image.

24. A method of forming image using a two-component developer which contains a carrier and an electrophotographic toner, said electrophotographic toner comprising at least a binder resin, a colorant and a resin negative charge control agent, wherein said binder resin is a polyester, a polyol, or a polyester and a polyol, and said resin negative charge control agent comprises polymerized units (1) sulfonic-acid containing monomers, (2) aromatic monomers having electron-withdrawing groups, and (3) at least one selected from the group consisting of methyl(meth)acrylate, ethyl(meth) acrylate, propyl(meth)acrylate, n-butyl(meth)acrylate, isobutyl(meth)acrylate, stearyl(meth)acrylate, dodecyl (meth)acrylate, 2-ethylhexylacrylate and combinations thereof, the method comprising:

forming a latent image on a latent image substrate;

developing the latent image, formed on the latent image substrate, using the two-component developer on a developer substrate;

transferring the developed toner image onto a transfer substrate; and heating the toner image on the transfer substrate thereby fixing the image onto the transfer substrate.

25. The method of forming image according to claim 24, further comprising forming a thin layer of the two-component developer on the developer substrate before developing the latent image, wherein when developing the latent image the thin layer of the two-component developer is contacted or non-contacted with the latent image substrate, in said developing.

26. The method of forming image according to claim 24, wherein latent images having colors different from each other are formed on the latent image substrates respectively by each color when forming the latent image on the latent image substrate;

using plurality of multi-color development apparatuses each provided with said developer substrate, and a development blade that regulates evenly layer-thickness of the two-component developer supplied onto said developer substrate, each colored latent image is developed onto said latent image substrate with the correspondingly colored developer held on said developer substrate, when developing the latent image; and said transfer substrate is abutted onto said latent image substrate surface using a transfer unit, and developed toner images differently colored from each other are transferring the developed toner image.

* * * * *